US005276482A

United States Patent [19]

Nakanishi

[11] Patent Number: 5,276,482

[45] Date of Patent: Jan. 4, 1994

[54] TEMPERATURE CONTROL DEVICE FOR A FIXING APPARATUS

[75] Inventor: Keiichi Nakanishi, Nagaokakyo, Japan

[73] Assignee: Murata Kikai Kabushiki Kaisha, Kyoto, Japan

[21] Appl. No.: 794,447

[22] Filed: Nov. 19, 1991

[30] Foreign Application Priority Data

Nov. 20, 1990 [JP] Japan ..... 2-316276

[51] Int. Cl.[5] ..... G03G 15/20

[52] U.S. Cl. ..... 355/208; 219/216; 355/285

[58] Field of Search ..... 355/285, 282, 208, 215; 219/216, 469

[56] References Cited

U.S. PATENT DOCUMENTS 4,609,278 9/1986 Taniguchi ..... 355/285
4,671,643 6/1987 Shigemura et al. ..... 355/282
4,719,489 1/1988 Ohkubo et al. ..... 355/290

FOREIGN PATENT DOCUMENTS 62-206580 9/1987 Japan .
1-271785 10/1989 Japan .

*Primary Examiner*—A. T. Grimley
*Assistant Examiner*—Nestor R. Ramirez
*Attorney, Agent, or Firm*—Spensley Horn Jubas & Lubitz

[57] ABSTRACT

An image forming device in which a toner on a sheet is heated by the heater of a fixing unit. The heater of the fixing unit is heated via a power supply. The temperature of the fixing unit is sensed by a temperature sensor. A controller increases the temperature of the fixing unit to a printing temperature in response to an output signal from the temperature sensor. When not printing, the controller turns off the power supply if the temperature of the fixing unit exceeds a set temperature (which set temperature is lower than the aforesaid printing temperature) and turns on the power supply if the temperature of the fixing unit is less than the set temperature.

2 Claims, 2 Drawing Sheets

TEMPERATURE CONTROL DEVICE FOR A FIXING APPARATUS

BACKGROUND OF THE INVENTION

1. Field of the Invention

This invention relates to an image forming device, and more particularly a temperature control for a fixing unit in an image forming device having a thermal fixing system.

2. Prior Art

The aforesaid image forming device has a fixing roller storing a heater therein, for example, and the fixing roller is heated by the aforesaid heater and then the toner on the recording sheet is fixed on the recording sheet. However, in the event that the image forming device is not used for a long period of time, the heating operation for the aforesaid fixing roller may cause an electrical power consumption to be increased, resulting in that its running cost is increased.

In view of this fact, there is proposed a method for turning off an electrical energization for the fixing roller so as to save an electrical power in the event that the image forming device is not used for a long period of time.

However, the aforesaid method has had some problems in that the temperature of another element, for example, a light sensing drum or the like in the image forming device having a set temperature accommodating range is remarkably reduced if the surrounding air temperature is excessively decreased, resulting in that an operation of the image forming device becomes unstable and the image quality is deteriorated.

In view of the foregoing, the present invention has been invented, and it is an object of the present invention to provide an image forming device which can prevent an image quality from being deteriorated while saving a consumption power.

SUMMARY OF THE INVENTION

In order to accomplish the aforesaid object, the present invention has a feature in an image forming device in which a toner on a sheet is heated by a fixing unit having a heater stored therein characterized in that there are provided a power supply for heating the heater, a temperature sensing means for sensing a temperature of the fixing unit, and a control means for increasing the fixing unit to a fixing temperature when printed in response to an output signal from the temperature sensing means and in turn other then the printing time, for turning off the power supply when the fixing unit shows a temperature more than the set temperature set lower than the aforesaid fixing temperature and turning on the power supply when the fixing unit shows a temperature less than the set temperature.

With the foregoing arrangement, the electrical power is not so consumed and the fixing unit is kept at the set temperature. Accordingly, the temperature within the image forming device can be kept at an appropriate temperature while saving the consumption power and then an excessive reduction in temperature of the element of which temperature accommodating range is set can be prevented.

DETAILED DESCRIPTION OF PREFERRED EMBODIMENT

Figure 1:
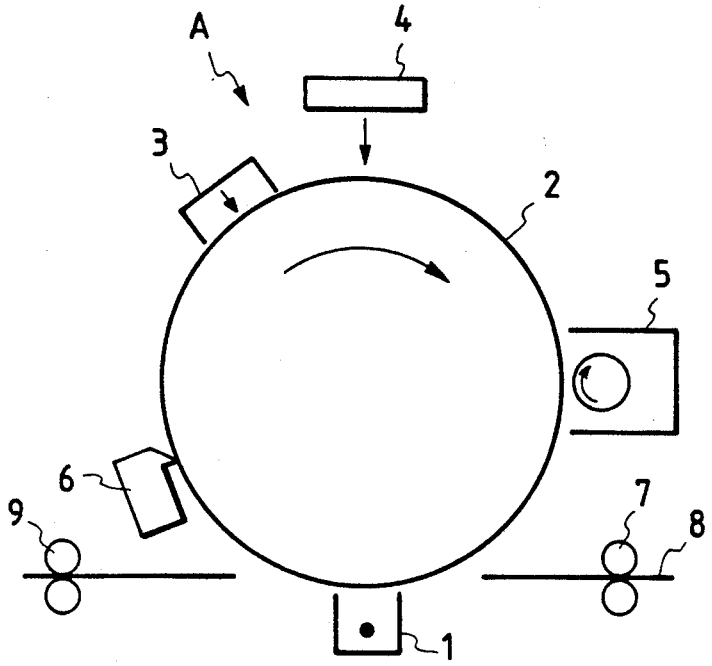
FIG. 1 is an entire configuration view for showing a copying device using a fixing device in accordance with the present invention.
Figure 2:
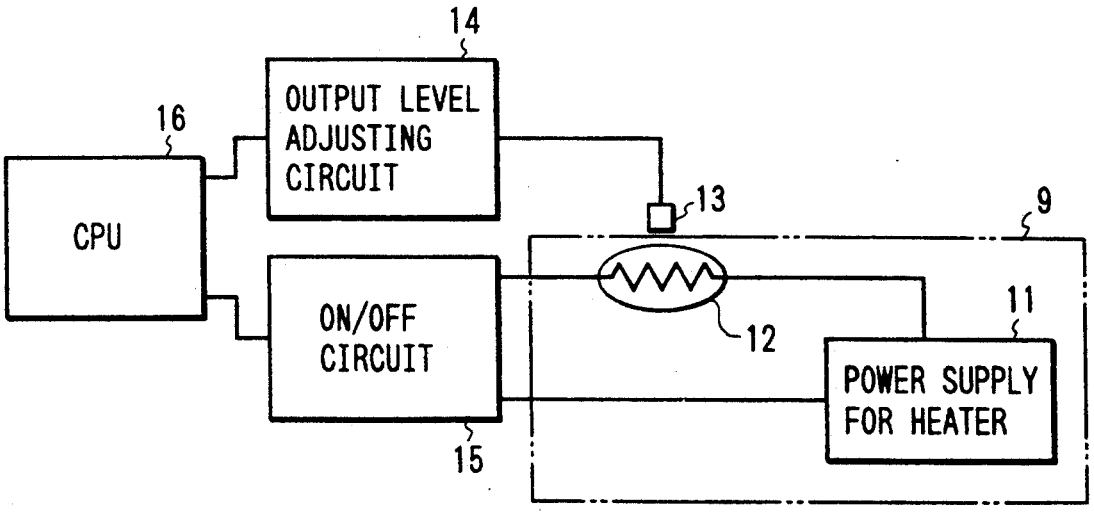
FIG. 2 is a block diagram for showing a temperature control circuit for a fixing device.
Figure 3:
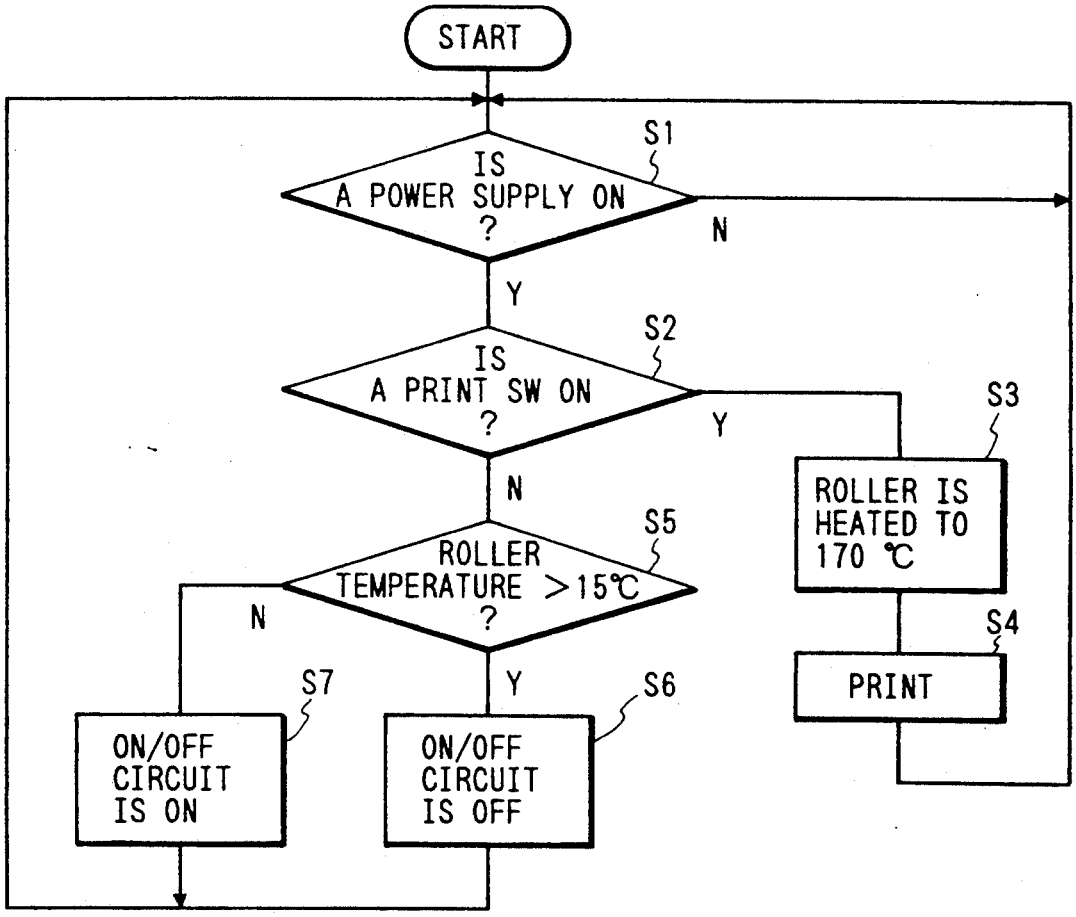
FIG. 3 is a flow-chart for showing a controlling order when the temperature of a fixing device is to be controlled.

Referring now to FIGS. 1 to 3, one preferred embodiment of the present invention will be described as follows. FIG. 1 is an entire configuration view for showing a copying device having a fixing device in accordance with the present invention. FIG. 2 is a block diagram for showing a temperature control circuit for a fixing device. FIG. 3 is a flow-chart for showing a controlling procedure when a temperature of a fixing device is to be controlled.

As shown in FIG. 1, the aforesaid copying device A has a photosensitive drum 2, wherein a light beam projected from an exposure part 4 is radiated onto the aforesaid photosensitive drum 2 to which an electrical charge is applied in advance by an electrical charger 3 so as to form an electrostatic latent image. Toner supplied from the developer 5 adhere to the electrostatic latent image on the photosensitive drum 2 to perform a developing action. After this operation a transferring operation to transfer the toner image on the photosensitive drum 2 onto the sheet 8 by the transfer charger 1 is carried out. The remaining toner not transferred to the sheet 8 during this transferring operation is scraped off by a blade in a cleaning box 6. In turn, the sheet 8 transported by the resist rollers 7 after finishing the transferring operation is processed with a fixing treatment while passing through the fixing device 9.

As shown in FIG. 2, the aforesaid fixing device 9 has a heater power supply 11 of AC 100 V and a heater 12 driven by the aforesaid heater power supply 11 stored in the fixing roller (not shown). A temperature control circuit in the fixing device having the aforesaid structure has a thermistor 13 arranged near the aforesaid fixing rollers, an output level adjusting circuit for adjusting the level of an output signal from the thermistor 13, an ON/OFF circuit 15 for turning on or off the heater 12, and a CPU 16 for controlling the aforesaid ON/OFF circuit 15 with a signal from the aforesaid output level adjusting circuit 14.

Then, the temperature controlling operation of the fixing device in the image forming device having the aforesaid configuration will be described in reference to the flow-chart of FIG. 3.

At first, it is judged whether the main power supply for the copying device is turned on or not (at the step S1), and, if the main power supply is turned on, a print switch (not shown) is judged if it is turned on or not (at the step S2). If the print switch is turned on, an ON signal is sent from the CPU 16 to the ON/OFF circuit 15, the heater 12 is electrically energized, resulting in that the fixing rollers are heated up to about 170° C. (at the step S3). After this operation, the printing operation is carried out (at the step S4).

In turn, if the printing switch is in its OFF state, it is judged whether the temperature of the fixing rollers is more than 15° C. or not (at the step S5). If the temperature is more than 15° C, the ON/OFF circuit 15 is kept at its OFF state and in turn if the temperature is less than 15° C., the ON/OFF circuit 15 is turned on to heat the fixing rollers with the heater 12. In this way, since the temperature of the fixing rollers is kept at a value more than the predetermined temperature (15° C. in the aforesaid preferred embodiment), it is possible to prevent the temperature in the copying device from excessively being decreased.

The copying device has been described in the preferred embodiment and the present invention is not limited to this preferred embodiment.

As described above, according to the present invention, the electrical power is not consumed so much and an excessive reduction of temperature of the element in the image forming device of which temperature accommodation range is set can be prevented.

As a result, the present invention has some effects that a quality of image can be improved while the consumption power is being saved.

What is claimed is:

1. An image forming device for performing a printing operation in which a toner on a sheet is heated by a heater of a fixing unit, the fixing unit defining a temperature, the device comprising:

power supply means for supplying power to the heater, temperature sensor means for sensing the temperature of the fixing unit and for generating an output signal in response thereto, means for increasing the temperature of the fixing unit to a first temperature in response to the output signal of the temperature sensor means, means for interrupting the supply of power from the power supply means to the heater when the temperature of the fixing unit is greater than a second temperature and the image forming device is not performing a printing operation, the second temperature being substantially lower than the first temperature, and means for continuing the supply of power from the power supply means to the heater when the temperature of the fixing unit is less than the second temperature, wherein the difference between the first temperature and the second temperature is equal to at least 100° C.

2. The device as in claim 1 wherein the second temperature is equal to approximately 15° C.

* * * * *